US005228547A

United States Patent [19]

Yoo

[11] Patent Number: 5,228,547

[45] Date of Patent: Jul. 20, 1993

[54] GOLF ACCESSORY BAG

[76] Inventor: Eddie B. Yoo, 2908 Long Lake Rd., Troy, Mich. 48098

[21] Appl. No.: 855,541

[22] Filed: Mar. 20, 1992

[51] Int. Cl.[5] ..... A45C 7/00

[52] U.S. Cl. ..... 190/103; 190/109; 190/111; 206/315.1

[58] Field of Search ..... 206/315.1; 190/103, 190/104, 105, 109, 111; 383/2, 103

[56] References Cited

U.S. PATENT DOCUMENTS

| | | | |
|---|---|---|---|
| D. 154,373 | 7/1949 | Feigl | D87/3 |
| D. 154,755 | 8/1949 | Feigl | D87/3 |
| D. 155,177 | 9/1949 | Nathan | D87/3 |
| D. 158,378 | 5/1950 | Handlen | D58/12.6 |
| D. 193,967 | 10/1962 | Schaefer | D87/5 |
| D. 259,677 | 6/1981 | Rosenow | D3/37 |
| D. 262,072 | 12/1981 | Pfeiffer | D3/36 |
| D. 268,713 | 4/1983 | Pelavin et al. | D3/48 |
| D. 278,190 | 4/1985 | Ganz | D3/48 |
| D. 281,741 | 12/1985 | Katz et al. | D3/48 |
| D. 284,332 | 6/1986 | Lowe et al. | D3/33 |
| D. 286,229 | 10/1986 | Knoepke et al. | 190/103 |
| 2,025,101 | 12/1935 | Halpin | 190/41 |
| 2,577,670 | 12/1951 | Adams | 190/111 |
| 2,691,401 | 10/1954 | Kontoff et al. | 150/52 |
| 3,122,225 | 2/1964 | Ward | 190/52 |
| 3,292,747 | 12/1966 | Dawson | 190/43 |
| 3,327,924 | 6/1967 | Brutting | 229/55 |
| 3,830,348 | 8/1974 | Ohyama | 190/43 |
| 3,989,080 | 11/1976 | Koszegi | 150/1.7 |
| 4,094,351 | 6/1978 | Catenaccio | 383/103 |
| 4,177,909 | 12/1979 | Haskell | 224/153 |
| 4,236,615 | 12/1980 | Ginat | 190/52 |
| 4,334,601 | 6/1982 | Davis | 190/44 |
| 4,361,215 | 11/1982 | Sawai | 190/103 |
| 4,513,866 | 4/1985 | Thomas | 190/111 |
| 4,733,759 | 3/1988 | Shih-Chen | 190/103 |
| 4,756,394 | 7/1988 | Cohen | 190/103 |
| 4,773,515 | 9/1988 | Kotkins, Jr. | 190/103 |
| 4,805,749 | 2/1989 | Gerch | 190/111 |
| 4,830,154 | 5/1989 | Gerch et al. | 190/103 |
| 4,923,060 | 5/1990 | Breslau | 206/316.2 |

FOREIGN PATENT DOCUMENTS

| | | | |
|---|---|---|---|
| 199326 | 2/1958 | Austria . | |
| 643888 | 7/1962 | Canada | 190/109 |
| 2902138 | 7/1980 | Fed. Rep. of Germany | 190/111 |
| 987540 | 8/1951 | France | 206/315.1 |
| 378477 | 7/1964 | Switzerland | 190/111 |

*Primary Examiner*—Gary E. Elkins
*Attorney, Agent, or Firm*—Spencer, Frank & Schneider

[57] ABSTRACT

A golf accessory bag includes a ventilated compartment for storing shoes having a shoe accessory sub-compartment for storing shoe care accessories and a top expandable compartment for storing items of clothing. The bag is provided with slide fasteners for opening and closing the ventilated and expandable compartments, and slide fasteners for expanding the expandable compartment.

20 Claims, 4 Drawing Sheets

GOLF ACCESSORY BAG

BACKGROUND OF THE INVENTION

1. Field of the Invention

The present invention relates generally to golf accessory bags. More specifically, the invention relates to an improved accessory bag having multiple compartments for separate storage of golf shoes and accessories, such as brushes and shoe polish, socks, gloves, shirts, and other clothing items, and including at least one expandable compartment.

2. Background Information

Prior to the present invention there were known numerous varieties of accessory bags, golf shoe bags, and the like. However, these generally were not adequate in meeting the needs of the modern golfer for a single bag in which golf shoes, clothing, and a variety of accessories could be conveniently carried.

One of the problems with the known bags, in particular golf shoe bags, was that they did not have separate compartments for items of clothing. Therefore, either another bag for the clothing needed to be used or else the clothing had to be placed in the same bag compartment as the shoes, often resulting in an undesirable contamination of the clothing with dirt or odor from the shoes.

Another problem is that, given the varying weather conditions that may be encountered on the golf course, a golfer might find it necessary to carry a jacket or sweater, in addition to a change of socks, and other items of clothing, one day, and have no need of them on another. Thus, the amount of storage capacity needed for clothes varies considerably and may disadvantageously require the golfer to have an assortment of bags available, with associated trouble and expense.

Therefore, there existed a need for a golf shoe and accessory bag having separate compartments for golf shoes and items of clothing, and having a clothes compartment with the ability to expand and collapse depending on the instantaneous needs of the user.

SUMMARY OF THE INVENTION

The present invention overcomes the above-mentioned problems and fills the above-mentioned needs by providing a golf shoe and accessory bag having a ventilated compartment including at least one shoe sub-compartment for the storage of golf shoes and a shoe accessory sub-compartment for the storage of shoe brushes, polish and the like, the bag further being provided with a top expandable compartment for the storage of items of clothing, the bag having slide fasteners for opening and closing the ventilated and expandable compartments, and for expanding the expandable compartment.

The bag according to the invention may also be advantageously provided with a clear plastic pocket disposed on the bottom for holding an identification card.

The bag according to the invention may also be advantageously provided with a small pocket disposed on the side of the bag for holding a shoe horn.

The bag according to the invention may also be advantageously provided with a cloth liner on the sides and/or the top of the golf shoe ventilated compartment to protect shoes carried therein from scuffing. The ventilated compartment may be provided with two ventilation holes on each side of the bag to provide adequate ventilation to the compartment. The ventilated compartment may be advantageously reinforced with molded plastic to provide a rigid structure, and may also include a divider structure for forming the sub-compartments for separating items stored therein. The molded plastic is advantageously fitted into a stitched border of the ventilated compartment.

The bag according to the invention may also be advantageously provided with a front pocket for carrying small or thin items such as country club brochures, golf course maps, address books, pocket calculators, Rolex watches, beepers, pagers, and the like.

The bag according to the invention may also be advantageously provided with a double-arched handle, one arch attached to the front and the other arch attached to the back of the bag, and having a wrap-around hand piece sewn into the middle of one of the handle arches and provided with a velcro-type closure so that it may be wrapped around both handle arches and secured to aid in hand-carrying the bag easily with comfort.

Other advantageous features will become apparent from the following description of a preferred embodiment taken with the accompanying drawings.

DETAILED DESCRIPTION OF THE PREFERRED EMBODIMENT

Figure 1:
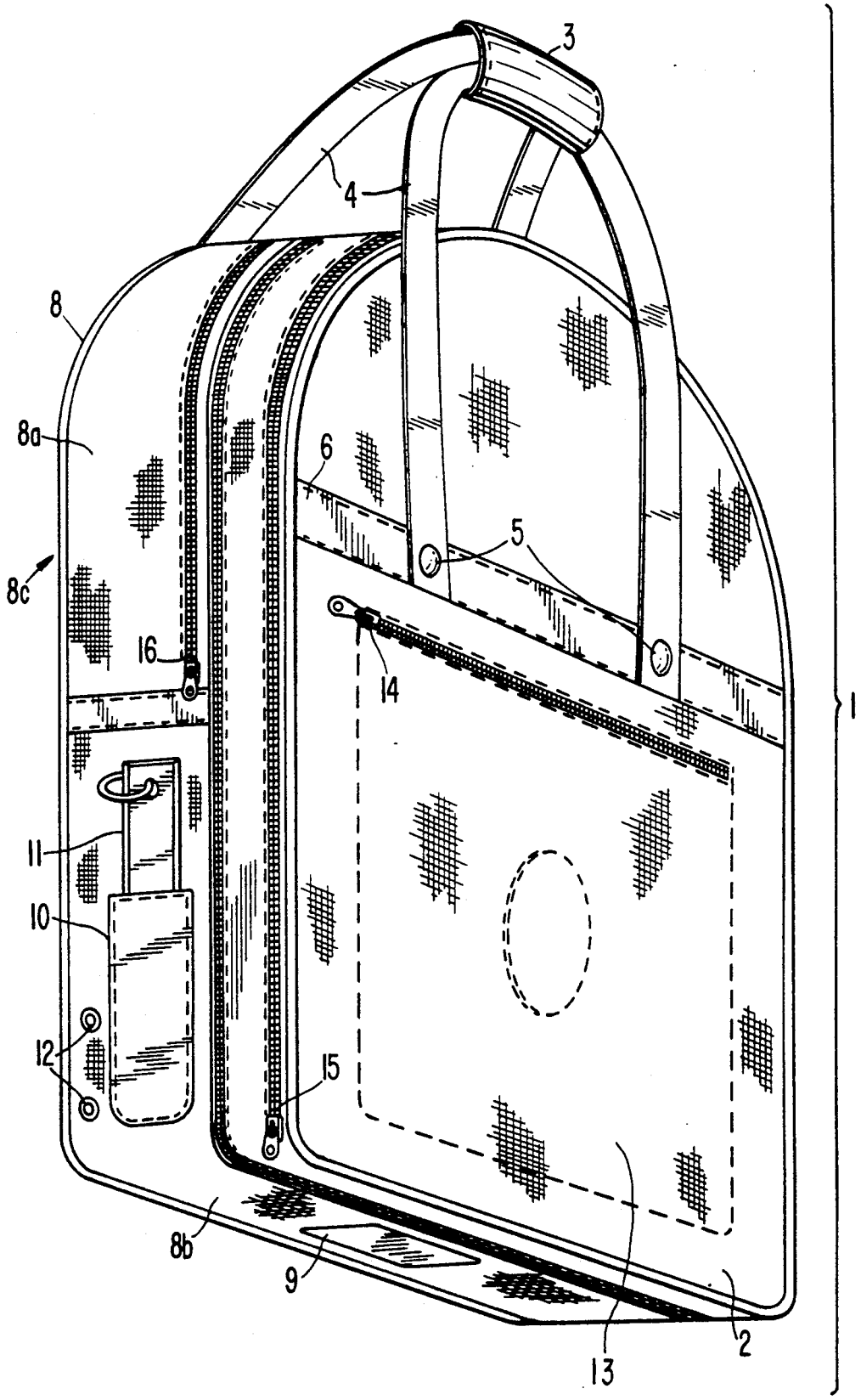
FIG. 1 is an exterior view of an embodiment of the invention.

An embodiment of the accessory bag according to the invention is shown in FIG. 1. The reference number 1 represent the accessory bag as a whole which is preferably constructed of several leather or vinyl material components sewn together and provided with zippers. The bag 1 is shown in an upright orientation as it would be when carried. The bag 1 has a front body portion 2 which is hinged to the bag 1 at the bottom. When the bag 1 is being carried, wrap-around hand piece 3 provides a comfortable fit to the human hand. Wrap-around hand piece 3 is sewn to the middle of one of the arches of double-arched handle 4 and is designed to wrap around the other arch and be removably fastened, by means of a velcro-type or other similarly acting fastener, e.g., one or more snaps. The double arched handle 4 may be securely attached to the bag 1 by grommets 5, or the like. The exterior panel of front body portion 2 of the bag 1 is reinforced with a strip of material 6 in the area where one arch of the double arched handle 4 is attached to the bag 1. A similar arrangement is provided on rear panel surface 8*c* (not shown) of back body portion 8 of the bag 1, and need not be described further. Portions of the bag 1, in particular parts of back body portion 8, may be rigidly reinforced with, for example, molded plastic. The bottom surface 8*b* of back body portion 8 is advantageously provided with a flat rigid reinforcement piece of molded plastic so that the bag rests stably when set down on a flat surface in the upright position.

When the bag 1 is to be opened to access the internal compartments for removal or storage of items therein, the bag 1 would normally be turned so that the rear panel surface 8*c* of the back body portion 8 is horizontally oriented and placed flat on a supporting surface. The rear panel surface 8*c* of back body portion 8 is then oriented as a bottom surface of the bag 1. The bottom surface 8*b* of back body portion 8 is then oriented as an end surface of the bag 1. The rear panel surface 8*c* is therefore likewise rigidly reinforced with a flat rigid molded plastic piece. The bottom surface 8*b* of back body portion 8 is advantageously provided with a clear plastic pocket 9 for holding an identification card or the like.

The side 8*a* of back body portion 8 is generally flat in the lower portion of the bag 1, and arched at the top. In the flat area of side 8*a* of back body portion 8 of the bag 1, a small side pocket 10 for holding a shoe horn 11, or similar item, is provided. Also provided in the flat area of side 8*a* of the bag 1 are dual ventilation holes 12 which provided a passage-way for air to enter and exit an internal shoe compartment of the bag 1, to be described in more detail later. Identical holes are provided on the side of the bag 1 not visible in the figure. The panels of back body portion 8 are securely sewn together and reinforced with molded plastic pieces to form a rigid structural unit, the interior surfaces of which form the bottom and sides of the internal shoe compartment.

The front body portion 2 of the bag 1 is provided with a front pocket 13 closed and opened by zipper 14. This provides a convenient place to store small items, especially small flat or thin items, easily accessible to the user without opening the rest of the bag. Inside the front body portion 2 an expandable compartment is formed, which will be described in detail later, and zipper 15 allows front body portion 2 to be opened to provide access to this expandable compartment. Front body portion is hinged to the bag at the bottom.

Zipper 16 similarly provides access to the internal shoe compartment mentioned above, and zipper arrangement 17 serves to expand the expandable compartment.

Figure 2:
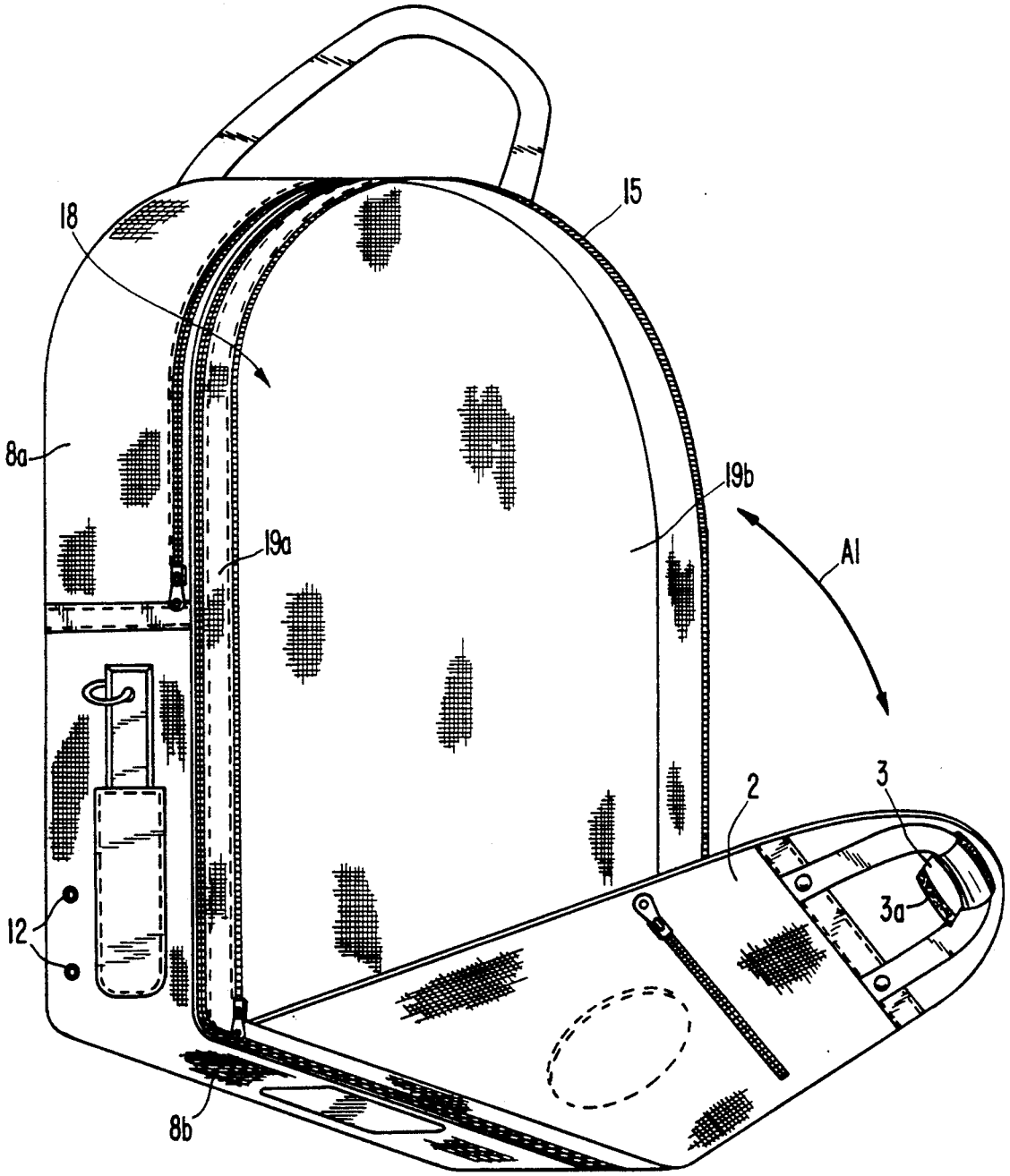
FIG. 2 shows the embodiment of FIG. 1 opened to show the top expandable compartment.

Referring now to FIG. 2, bag 1 is shown in an upright position with zipper 15 opened, i.e., unzipped, and front body portion 2 swung forward and down as indicated by the arrow A1 to expose the expandable compartment 18. In use the bag 1 would normally be oriented horizontally before opening. Expandable compartment 18 is defined by the inside surface of front body portion 2, an expandable arched side panel 19*a* and a reinforced rear panel 19*b*. This expandable compartment 18 is advantageously used to store items of clothing such as shirts, socks, sweaters, and the like, and the surfaces are, therefore, preferably lined with fabric. The expandability of the expandable compartment 18 is provided by the zipper arrangement 17 on expandable arched side panel 19*a*, the details of which will be described later. Arched side panel 19*a* and reinforced rear panel 19*b* are securely sewn together to form a single structural unit.

Also visible in an open or unwrapped condition in FIG. 2 is velcro-type fastener 3*a* on wrap-around hand piece 3. To fully open the bag 1 to more easily access the various inner compartments, such as expandable compartment 18, wrap-around hand piece 3 would be unfastened and unwrapped so that the arches of dual-arch handle 4 may be separated.

Figure 3:
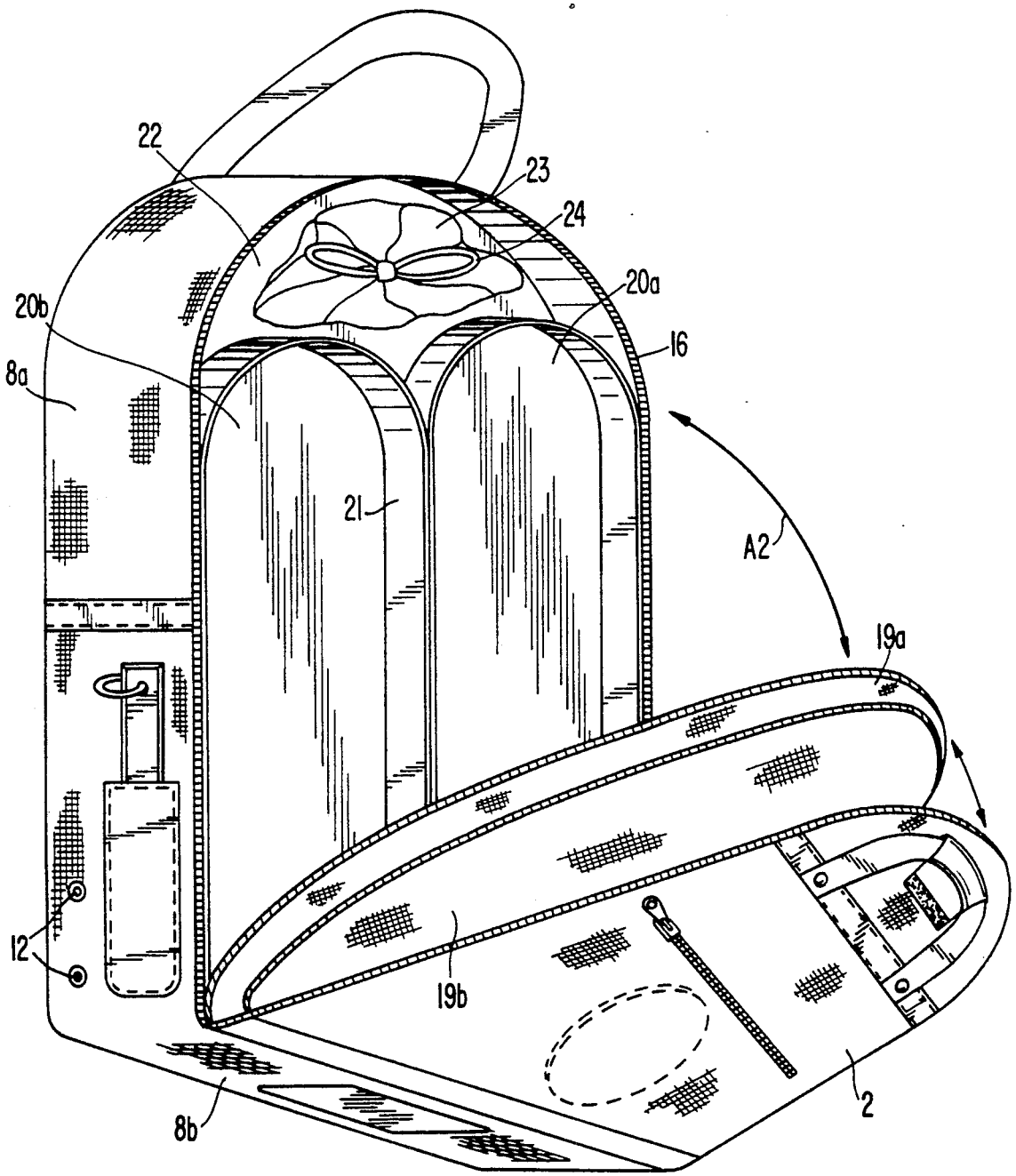
FIG. 3 shows the embodiment of FIGS. 1 and 2 further opened to show the ventilated shoe compartment including sub-compartments.

Referring now to FIG. 3, the bag 1 is now shown with both zippers 15 and 16 opened, i.e., unzipped, and with the rear panel 19*b* and arched side panel 19*a* swung down and away, as indicated by arrow A2, to expose further inner compartments. Rear panel 19*b* and arched side panel 19*a* are hinged at the bottom in a similar fashion to front body portion 2. The now visible further inner compartments include right and left-side shoe sub-compartments, 20*a* and 20*b* respectively, which are partially formed and separated by shoe protection divider 21, and an end shoe accessory compartment 22. The dual ventilation holes 12 enter the left-side shoe sub-compartment 21*b* as earlier described to provide a passageway for ventilation air, and right-side shoe sub-compartment is likewise provided with dual ventilation holes, not shown. End shoe accessory sub-compartment 22 is shown containing a shoe accessory pouch 23 having rope-tie 24 for opening and closing the shoe accessory pouch 23. Shoe brushes, shoe polish, or the like may be conveniently stored in this area, i.e., sub-compartment 22.

The rear-ward inside surface of rear panel 19*b*, the inside surfaces of back body portion 8, and the shoe protection divider 21 define the sub-compartments 20*a*, 20*b* and 22. Rear panel 19*b* and back body portion 8 are advantageously provided with molded plastic reinforcement, as mentioned earlier. Shoe protection divider 21 is also advantageously formed with molded plastic. In this way, a rigid compartment arrangement is provided for containing golf shoes and accessories. The component parts 19*b*, 8, and 21 forming the right and left-side shoe sub-compartments 20*a* and 20*b* may be further advantageously provided with a cloth lining to protect shoes stored therein from scuffing due to jostling which may occur during transportation of the bag 1.

Figure 4:
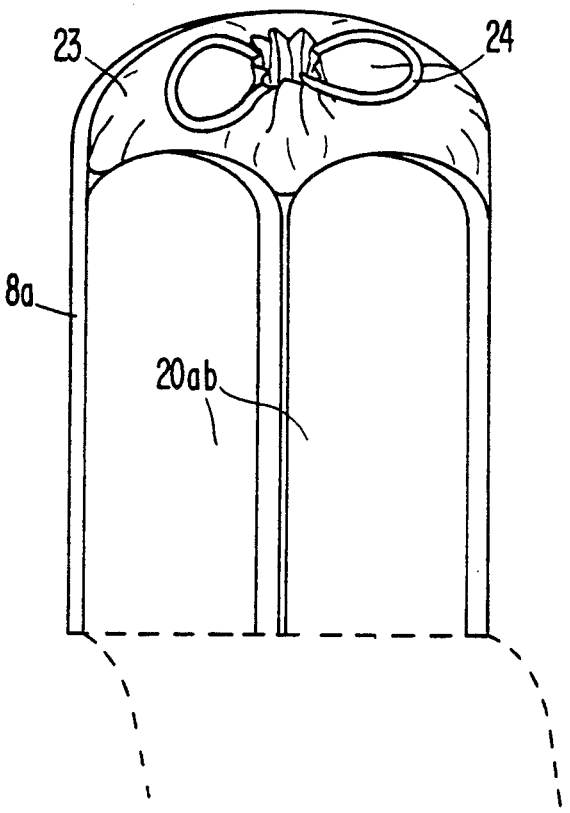
FIG. 4 illustrates advantageous features of the ventilated shoe compartment including sub-compartments.
Figure 4A:
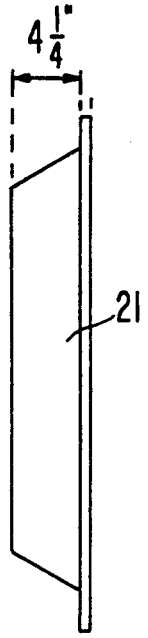
FIG. 4*a* illustrates the shoe protection divider.

Referring now to FIGS. 4 and 4*a*, the shoe sub-compartments 20*a* and 20*b* are shown, along with a shoe accessory pouch 23 in sub-compartment 22. FIG. 4*a* indicates a preferred depth dimension of the compartment arrangement, including shoe protection divider 21, of $4\frac{1}{4}$ inches.

Figure 5:
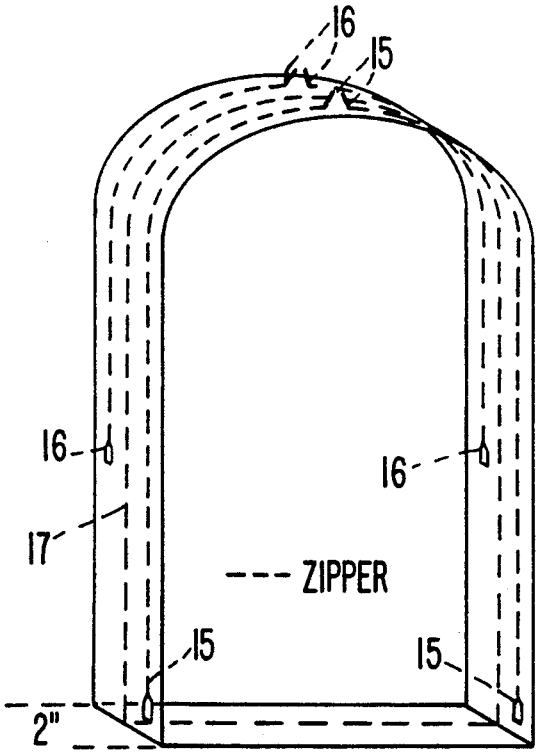
FIGS. 5 and 5*a* show schematically the top expandable compartment and zipper arrangement.
Figure 5A:
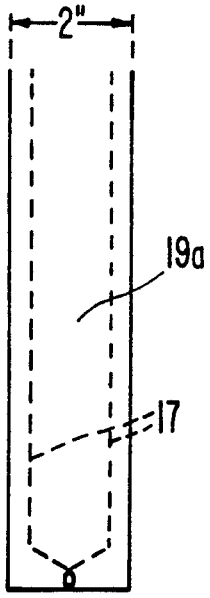

Referring now to FIGS. 5 and 5*a*, the orientation and locations of the various zippers 15, 16 and zipper arrangement 17, are illustrated schematically. Zippers 15 close the expandable compartment 18 when they are pulled together and open the expandable compartment when they are pulled apart in opposite directions. Likewise, zippers 16 open and close the ventilated compartment arrangement having sub-compartments 20*a*, 20*b* and 22.

Zipper arrangement 17 serves to expand the expandable compartment 18 by widening expandable arched side panel 19*a*, as shown in FIG. 5*a*, when opened. The width of expandable arched side panel 19*a* determines the depth of the expandable compartment 18. On the other hand, the expandable arched side panel 19*a* is narrowed when zipper arrangement 17 is closed. In this way the volume of the expandable compartment 18 may be advantageously varied by changing the depth of the expandable compartment 18, to suit the instantaneous needs of the user. Zipper arrangement 17 is designed to make a little more that one full trip around the perimeter of the expandable arched side panel 19*a* of bag 1, partially overlapping itself at one end. FIG. 5*a* indicates a preferred dimension for side panel 19*a* of two inches fully expanded.

It will be understood that the above description of the present invention is susceptible to various modifications, changes and adaptations, and the same are intended to be comprehended within the meaning and range of equivalents of the appended claims.

I claim:

1. A multi-compartment bag having a ventilated compartment for storage of golf shoes, and an expansible compartment for storage of items of clothing, wherein the ventilated compartment includes dividing means for forming a plurality of sub-compartments, the sub-compartments including at least one shoe sub-compartment and at least one shoe accessory sub-compartment; reinforcing means for forming rigid wall members of the ventilated compartment; air passage means for providing a passageway for ventilation air to enter and exit the ventilated compartment from outside the bag; and fastening means for opening and closing the ventilated compartment; and wherein the expansible compartment includes an expansible panel having a slide fastener for expanding and collapsing the expansible compartment by opening and closing thereof, respectively.

2. The multi-compartment bag according to claim 1, further comprising a clear plastic pocket disposed on an exterior bottom surface of the bag for holding an identification card.

3. The multi-compartment bag according to claim 1, further comprising a small pocket having an opening disposed on an exterior side surface of the bag for holding a shoe horn.

4. The multi-compartment bag according to claim 1, wherein the ventilated compartment includes a cloth lining on at least some inside surfaces thereof so that at least a top of the shoe sub-compartment is thereby lined to protect shoes carried therein from scuffing.

5. The multi-compartment bag according to claim 1, wherein the reinforcing means comprises molded plastic fitted into stitched borders of the bag wall members.

6. The multi-compartment bag according to claim 1, wherein the dividing means is composed of molded plastic.

7. The multi-compartment bag according to claim 1, further comprising a front pocket having an opening disposed on an exterior surface of the bag for carrying small items therein.

8. The multi-compartment bag according to claim 1, wherein the fastening means comprises zippers.

9. The multi-compartment bag according to claim 1, wherein the air passage means comprises two holes disposed on opposite sides of the bag.

10. The multi-compartment bag according to claim 1, further comprising carrying means for facilitating hand carrying of the bag, the carrying means including a double-arched handle, one of the arches attached to a first exterior surface of the bag and the other of the arches attached to a second exterior surface of the bag, the handle having a wrap-around hand piece sewn into a middle portion of one of the arches and provided with a velcro-type closure so that the wrap-around piece may be wrapped around both handle arches and secured to aid in hand-carrying the bag.

11. A golf accessory bag, having first, second and third body portions, wherein:

a ventilated compartment is formed by and between the first and second body portions, the first body portion being provided with divider means for forming at least one shoe sub-compartment for storing shoes and a shoe accessory sub-compartment for storing shoe care accessories;

an expandable compartment is formed by and between the second and third body portions, for storing items of clothing, the second body portion being provided with fasteners for adjusting a width thereof thereby expanding the expandable compartment; and the first, second and third body portions are provided with fasteners along adjacent edges for opening and closing the ventilated and expandable compartments.

12. The golf accessory bag according to claim 11, further comprising a clear plastic pocket disposed on an exterior bottom surface of the first body portion of the bag for holding an identification card.

13. The golf accessory bag according to claim 11, further comprising a small pocket having an opening disposed on an exterior side surface of the first body portion of the bag for holding a shoe horn.

14. The golf accessory bag according to claim 11, wherein the first and second body portions forming the ventilated compartment include a cloth lining on at least some inside surfaces thereof so that at least one side of the shoe sub-compartment is thereby lined to protect shoes carried therein from scuffing.

15. The golf accessory bag according to claim 11, wherein the ventilated compartment is provided with ventilation holes disposed in the first body portion on each side of the bag to provide ventilation of the compartment.

16. The golf accessory bag according to claim 11, wherein at least one of the first and second body portions forming the ventilated compartment is reinforced with molded plastic to provide a rigid structure.

17. The golf accessory bag according to claim 16, wherein the molded plastic is fitted into stitched borders of the first and second body portions forming the ventilated compartment.

18. The golf accessory bag according to claim 16, wherein the ventilated compartment divider means, for forming the shoe and shoe accessory sub-compartments therein, is composed of molded plastic.

19. The golf accessory bag according to claim 11, further comprising a front pocket having an opening disposed on an exterior surface of the third body portion of the bag for carrying small items therein.

20. The golf accessory bag according to claim 11, further comprising a double-arched handle, one of the arches attached to an exterior surface of the third body portion of the bag and the other of the arches attached to an exterior surface of the first body portion of the bag, the handle having a wrap-around hand piece sewn into a middle portion of one of the arches and provided with a closure so that the wrap-around piece may be wrapped around both handle arches and secured to aid in hand-carrying the bag.

* * * * *